US006940028B2

(12) United States Patent
Eggers

(10) Patent No.: US 6,940,028 B2
(45) Date of Patent: Sep. 6, 2005

(54) SWITCH DEACTIVATION DEVICE

(76) Inventor: Eddie Eggers, 4545 Zoeller, Indianapolis, IN (US) 46226

( * ) Notice: Subject to any disclaimer, the term of this patent is extended or adjusted under 35 U.S.C. 154(b) by 0 days.

(21) Appl. No.: 10/945,168

(22) Filed: Sep. 20, 2004

(65) Prior Publication Data

US 2005/0072660 A1 Apr. 7, 2005

Related U.S. Application Data

(60) Provisional application No. 60/504,806, filed on Sep. 22, 2003.

(51) Int. Cl.[7] ..... H01H 9/28

(52) U.S. Cl. ..... 200/43.19; 200/43.22; 200/43.01

(58) Field of Search ..... 200/43.01–43.22

(56) References Cited

U.S. PATENT DOCUMENTS

| | | | | | |
|---|---|---|---|---|---|
| 4,996,400 | A | * | 2/1991 | Ricci et al. | 200/345 |
| 5,676,409 | A | * | 10/1997 | Trammell, Jr. | 292/336.3 |
| 5,949,039 | A | * | 9/1999 | Koek et al. | 200/50.1 |
| 6,130,596 | A | * | 10/2000 | Yu | 337/50 |
| 6,710,695 | B1 | * | 3/2004 | Pellon et al. | 337/66 |

* cited by examiner

*Primary Examiner*—Richard K. Lee
(74) *Attorney, Agent, or Firm*—Barnes & Thornburg LLP

(57) ABSTRACT

A switch deactivation device includes a coil portion having a number of coils. The coils are configured to couple to a portion of a vehicle door switch, such as a plunger shaft or a mounting flange. The coils may be coupled to the portion of the switch by adjusting an internal diameter of the coils. The device also includes a plunger-engaging portion configured to depress a plunger of the vehicle door switch while the device is coupled to the switch.

22 Claims, 4 Drawing Sheets

SWITCH DEACTIVATION DEVICE

This application claims priority under 35 U.S.C. § 119(e) to U.S. Provisional Application Ser. No. 60/504,806, filed on Sep. 22, 2003, the entirety of which is hereby incorporated by reference herein.

BACKGROUND OF THE INVENTION

The present disclosure relates generally to devices for deactivating a switch, and more particularly to devices for deactivating a vehicle door switch.

Motor vehicles include a number of vehicle door switches, typically, one switch per door. The door switches, sometimes referred to as door "pin" switches, are part of an electrical circuit of the vehicle. When the door switch is activated, for example, by opening the associated door, the electrical circuit typically performs a set of predefined functions such as illuminating an overhead light, initiating an "open door" enunciator, visually notifying the driver of the open door, and the like.

Some motor vehicles have removable doors such as the DaimlerChrysler Jeep series of vehicles. Under certain circumstances, for example during "off-road" traveling, it may be desirable to remove the vehicle doors from the body of the vehicle. When a vehicle door is removed from the vehicle, the associated door switch is continuously activated causing the electrical circuit to perform the set of predefined functions. For example, removal of a vehicle door may cause an overhead light located in the vehicle to illuminate constantly. A typical remedy for the continuous activation of the door switch is the removal of the fuse associated with the door switch electrical circuit from the vehicle fuse box. Removing the associated fuse removes power from the door switch electrical circuit and stops the circuit from performing the set of predefined functions. However, removal of the associated fuse may also remove power from other desirable circuits. For example, removing the associated fuse may cause interior lights, navigational systems, rear view mirror lights, and other auxiliary systems to be rendered nonfunctional.

SUMMARY OF THE INVENTION

The present invention comprises one or more of the features recited in the appended claims and/or the following features which, alone or in any combination, may comprise patentable subject matter:

A device for deactivating a vehicle door switch is provided. The device may include a coil portion. The coil portion may be a spring coil and may include any number of individual coils. The coil(s) may be configured to couple to a portion of the vehicle door switch such as a plunger shaft or mounting flange. For example, the coil(s) may have an adjustable internal diameter. The internal diameter of the coil(s) may be adjustable to a range of diameters to allow the coil portion to be coupled to any one of a number of vehicle door switches having a variety of dimensions. The internal diameter may be momentarily increased to allow the device to be coupled to the portion of the switch. The internal diameter may subsequently return to a relaxed state diameter.

The device may also include a plunger-engaging portion. The plunger-engaging portion may be configured to contact and depress a plunger of the vehicle door switch while the device is coupled to the switch. The plunger-engaging portion may be coupled to the coil portions. The plunger-engaging portion and the coil portion may also form integral portion. The plunger-engaging portion may traverse a longitudinal axis defined by the coil portion.

The device may further include a first end segment coupled to a first end of the coil portion and a second end segment coupled to a second end of the coil portion. The first and second end segments may include finger pads at ends opposite the coil portion ends. The first and second segments may be moved toward each other to increase the inner diameter of the coil(s). The finger pads may be used to move the first and second segments. For example, a user of the device may place a thumb and finger on the pads and apply a "pinching" or otherwise inward force on the pads to cause the segments to be moved toward each other. The plunger-engaging portion may be coupled to the first or second end segments. The plunger-engaging portion may also form a portion of the first or second end segments. The coil portion, plunger-engaging portion, and the end segments may form integral portions. The plunger-engaging portion may be made from any material capable of depressing the plunger of the switch without substantial deformity, such as metallic or plastic materials. Similarly, the end segments may be made from any material capable of withstanding the inward pressure applied to the end segments during use of the device, such as metallic or plastic materials. The coil portion may be made from any material capable of allowing the inner diameter of the coil portion to be momentarily increased, such as metallic or plastic materials. For example, the coil portion may be made from spring steel such as music wire.

A method for deactivating a vehicle door switch is also provided. The method may include coupling at least one coil of the device to a portion of the vehicle door switch such as a plunger shaft or a mounting flange. The coil(s) may be coupled to the portion of the vehicle door switch by, for example, momentarily increasing an internal diameter of the coil(s). The method also includes depressing a plunger of the vehicle door switch with a portion of the device. The plunger may be depressed to a position at which the vehicle door switch is deactivated. The plunger may be held in a depressed position while the coil(s) is coupled to the portion of the vehicle door switch.

The above and other features of the present disclosure, which alone or in any combination may comprise patentable subject matter, will become apparent from the following description and the attached drawings.

BRIEF DESCRIPTION OF THE DRAWINGS

The detailed description particularly refers to the following figures, in which.

DETAILED DESCRIPTION OF THE DRAWINGS

Figure 1:
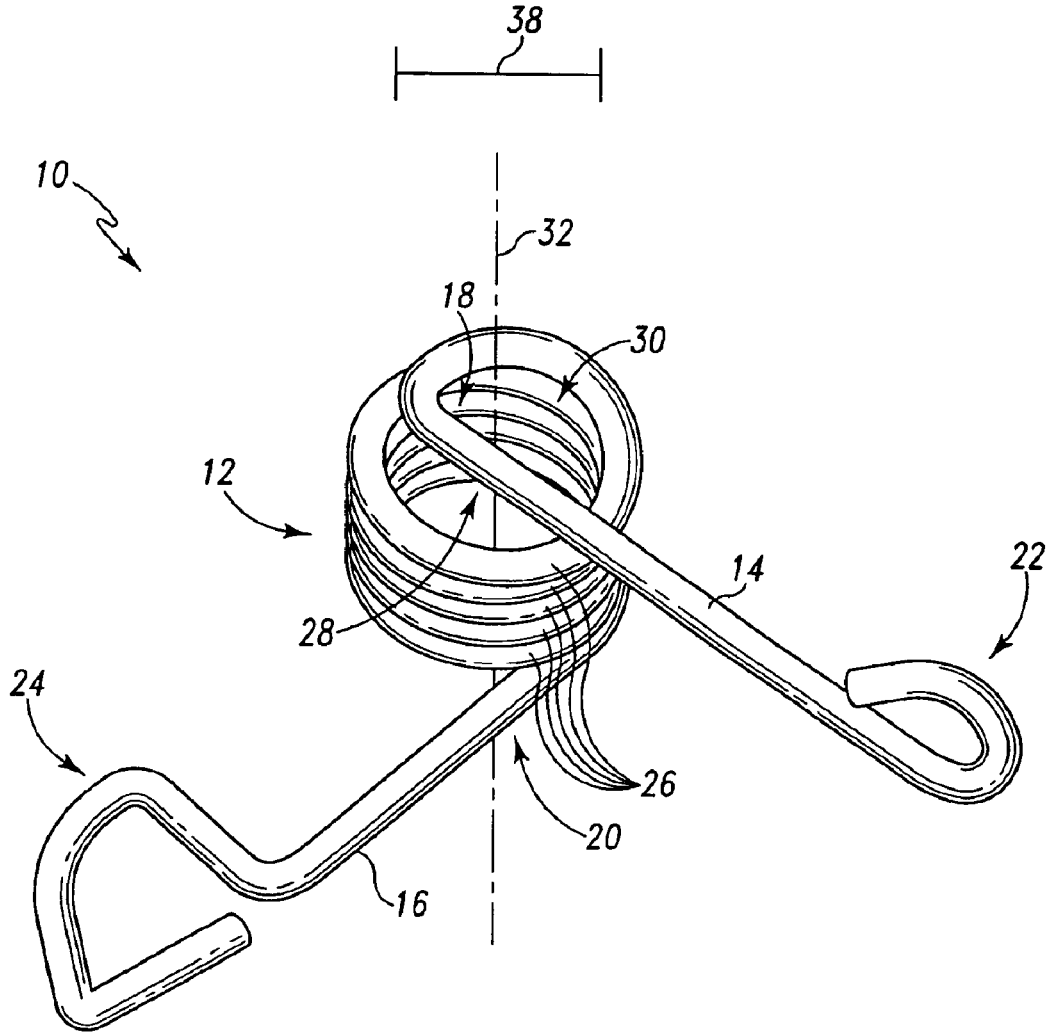
FIG. 1 is a perspective view of a switch deactivation device having a coil portion and a plunger-engaging portion.

While the concepts of the present disclosure are susceptible to various modifications and alternative forms, specific exemplary embodiments thereof have been shown by way of example in the drawings and will herein be described in detail. It should be understood, however, that there is no intent to limit the concepts of the present disclosure to the particular forms disclosed, but on the contrary, the intention is to cover all modifications, equivalents, and alternatives falling within the spirit and scope of the disclosure.

Vehicle door switches may function differently according to such parameters as the make, model, and year of the vehicle in which the door switch is used. Some door switches are normally closed (N.C.) switches. A normally closed door switch completes an associated electrical circuit during activation and interrupts the electrical circuit during deactivation. Other door switches are normally open (N.O.) switches. A normally open door switch interrupts an associated electrical circuit during activation and completes the electrical circuit during deactivation. Additionally, some vehicle door switches may be positive switches and provide a supply voltage to the associated electrical circuit during activation. Other door switches may be negative switches and provide a reference voltage to the associated electrical circuit during activation. Regardless of the type of switch, as used herein, a vehicle door switch is "activated" when the switch or portion thereof is positioned in a position which causes actuation of an associated vehicle function such as illumination of an interior light. For example, a plunger-type vehicle door switch is "activated" when a plunger of the switch is extended such as when the associated door is open or removed from the vehicle. Conversely, a vehicle door switch is "deactivated" when the switch or portion thereof is positioned in a position which causes deactuation of an associated vehicle function such as the turning off of an interior light. For example, a plunger-type vehicle door switch is "deactivated" when it is retracted or otherwise depressed such as when the associated vehicle door is closed.

Figure 3:
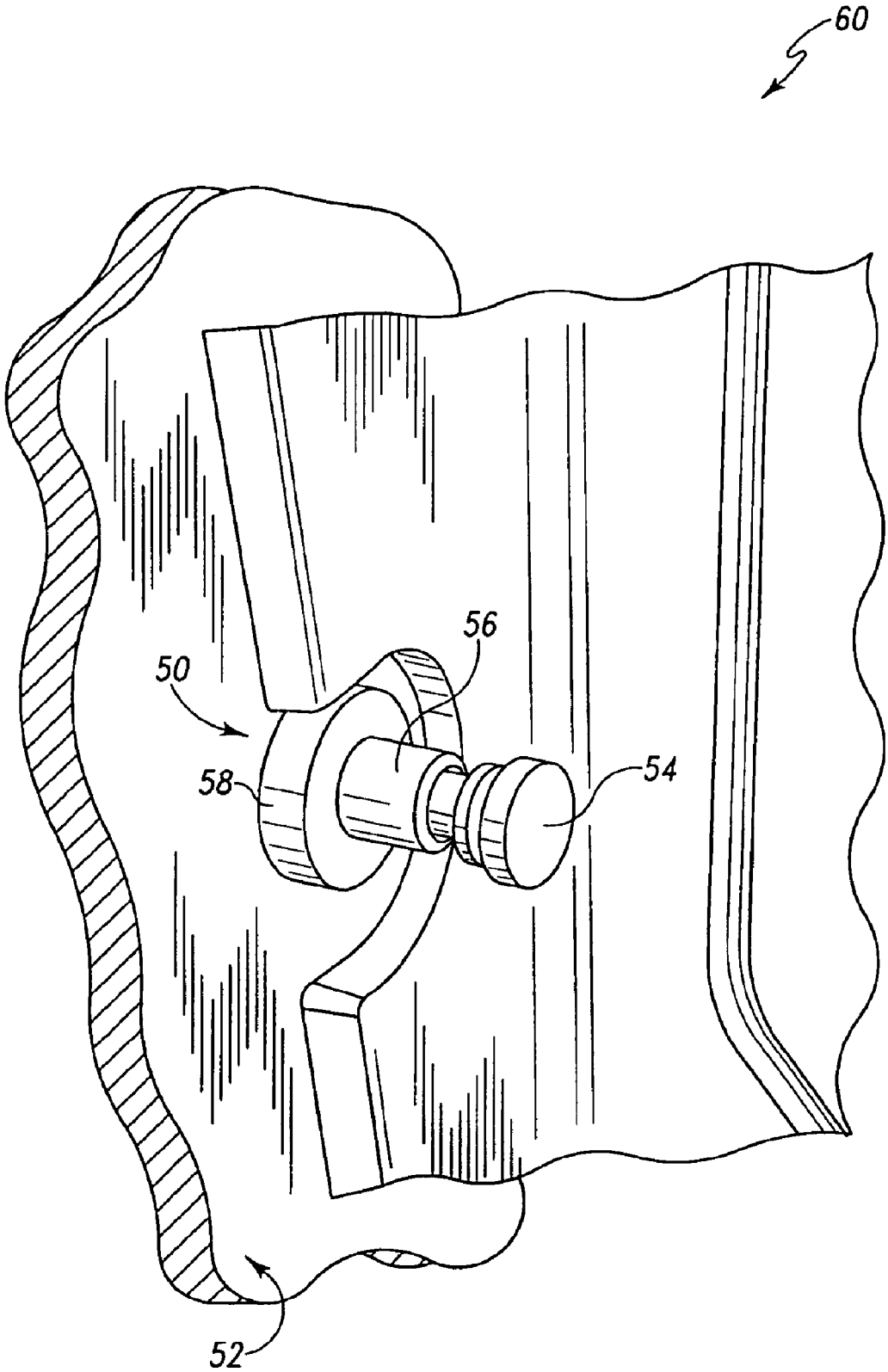
FIG. 3 is a partial perspective view of a vehicle door frame having a vehicle door switch in an extended position located thereon.

A typical plunger-type vehicle door switch 50 is shown in FIG. 3. Many vehicle door switches 50 are mounted on a forward door frame 52 or a rear door frame (not shown) of a motor vehicle 60 such as a 2003 Jeep Rubicon, commercially available from DaimlerChrysler of Auburn Hills, Mich. The vehicle door switch 50 includes a mounting flange 58, a plunger shaft 56 connected to the flange 58, and a plunger 54 having a portion positioned in the plunger shaft 56. The switch 50 is mounted to the vehicle so that the flange 58 contacts a surface of the vehicle such as the inner door frame 52. The switch is operable to detect the opening and closing of an associated vehicle door based on the position of the plunger 54. Specifically, when a vehicle door is closed, the plunger 54 of the switch 50 is positioned in a retracted or otherwise depressed position. Conversely, when the vehicle door is opened, the plunger 54 springs outward from the retracted or depressed position into an extended position. An inner biasing spring (not shown) or other biasing device applies an outward force on the plunger 54 to bias the plunger 54 into its extended position. As described above, the switch 50 is activated when the plunger 54 is positioned in its extended position and deactivated when the plunger 54 is positioned in its retracted or depressed position It should be appreciated that the illustrative vehicle door switch 50 represents only one embodiment of a vehicle door switch and that the present disclosure is applicable to other vehicle door switches having various lengths, diameters, shapes, configurations, and dimensions.

Referring now to FIG. 1, a switch deactivation device 10 includes a coil portion 12, a first end segment 14, and a second end segment 16. The first end segment 14 is connected to a first end 18 of the coil portion 12. The second end segment 16 is connected to a second end 20 of the portion 12. The first and second end segments 14, 16 include finger pads 22 and 24, respectively, at distal ends. The coil portion 12 and the end segments 14, 16 may form integral portions, as illustrated in FIG. 1, or may be separate members coupled or secured together. The coil portion 12 may include any number of coils 26. In one particular embodiment, the coil portion 12 includes five coils 26. In some embodiments, the coil portion 12 may form a spring coil.

The device 10 also includes a plunger-engaging portion 28. In the illustrative embodiment, the plunger-engaging portion 28 forms a portion of the first end segment 14. In alternative embodiments, the plunger-engaging portion 28 may be separate member secured to the segment 14 using any suitable attachment method such as welding processes, adhesives, or other attachment methods. The portion 28 extends over an inner opening 30 of the coil portion 12 in a position to contact the plunger 54 of the vehicle door switch 50 when the device 10 is coupled to the switch 50. In the embodiment illustrated in FIG. 1, the portion 28 crosses a longitudinal axis 32 of the coil portion 12.

The coil portion 12 of the device 10 may be formed from a variety of materials which exhibit an amount of form memory when the material is deformed such as spring steel or plastic materials. For example, the coil portion 12 may be formed from high-carbon spring steels, alloy spring steels, stainless spring steels, copper-based spring alloys, nickel-base spring alloys, or the like. In one particular embodiment, the coil portion 12 is formed from ASTM A228 music wire. A non-corrosive coating may also be applied to the coil portion 12. The coil portion 12 may be formed from wire having any one of a number of cross-sectional profiles including, but not limited to, circular, elliptical, square, and rectangular cross-sections. The diameter of the wire used to form the coil portion 12 may vary depending on the application, the number of coils 26, and/or other criteria. In one particular embodiment, the diameter of the wire used to form the coil portion 12 is seventy thousandths of an inch. The coil portion 12 may be right-hand or left-hand wound.

The segment ends 14 and 16 may be formed from any rigid material capable of withstanding the inward pressure applied to the end segments 14, 16 during use of the device 10. For example, the segment ends 14, 16 may be made from metallic or plastic materials. The plunger-engaging portion 28 may be made from any material capable of depressing the plunger of the switch without substantial deformity during use of the device 10, such as metallic or plastic materials. In the illustrative embodiment of FIG. 1, the segment ends 14, 16 and the plunger-engaging portion 28 are formed from the same material as the coil portion 12. However, in other embodiments, the coil portion 12 may be made from a spring steel material and the segments 14, 16 and the plunger engaging portion 28 may be made from plastic. Alternatively, the entire device 10 may be formed from a plastic material.

The device 10 may be constructed using any one a number of processing methods. For example, the device 10 may be machined, die-pressed, formed, die cast, or the like. Such processes may be single part processes or may involve the processing of a number of separate parts to form the device 10. For example, as shown in the illustrative embodiment of FIG. 1, the coil portion 12, segments 14, 16, and plunger-engaging portion 28 may be formed from a monolithic rod of spring steel or other suitable material. The coil portion 12 may be formed by establishing a number of loops centrally in the rod. The pads 22, 24 may be formed by terminating the ends of the rod in loops large enough to provide a finger support. In the illustrative embodiment of FIG. 1, the finger pad 24 is larger and of different shape than the finger pad 22 to provide enough support for the thumb of the user. However, in other embodiment, the pads 22, 24 may be similarly sized and shaped.

Figure 2:
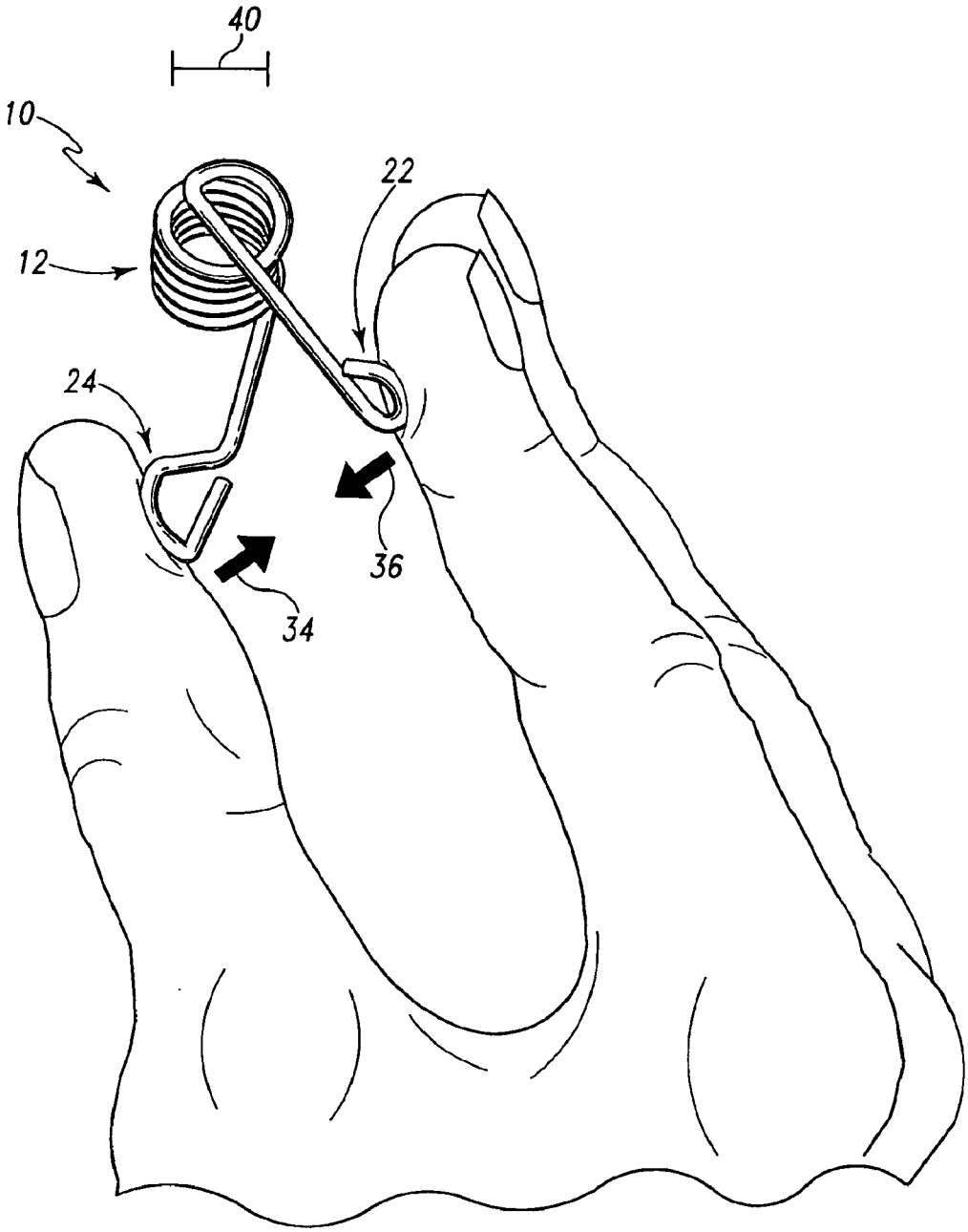
FIG. 2 is a perspective view of the device of FIG. 1 being operated by a user to increase the inner diameter of the coil portion.

In operation, a user of the switch deactivation device 10 provides an inward pressure on the finger pads 22, 24 by gripping the pads 22, 24 between the user's fingers as shown in FIG. 2. Applying an inward pressure to the finger pads 22, 24 causes the pads 22, 24 to move in an inward direction toward one another as shown with arrows 34, 36, respectively. Such movement of the pads 22, 24 forces the inner diameter of the coil portion 12 (i.e. the coils 26 of the portion 12) to enlarge from a relaxed state diameter 38 (see FIG. 1) to a biased state diameter 40 as shown in FIG. 2.

Figure 4:
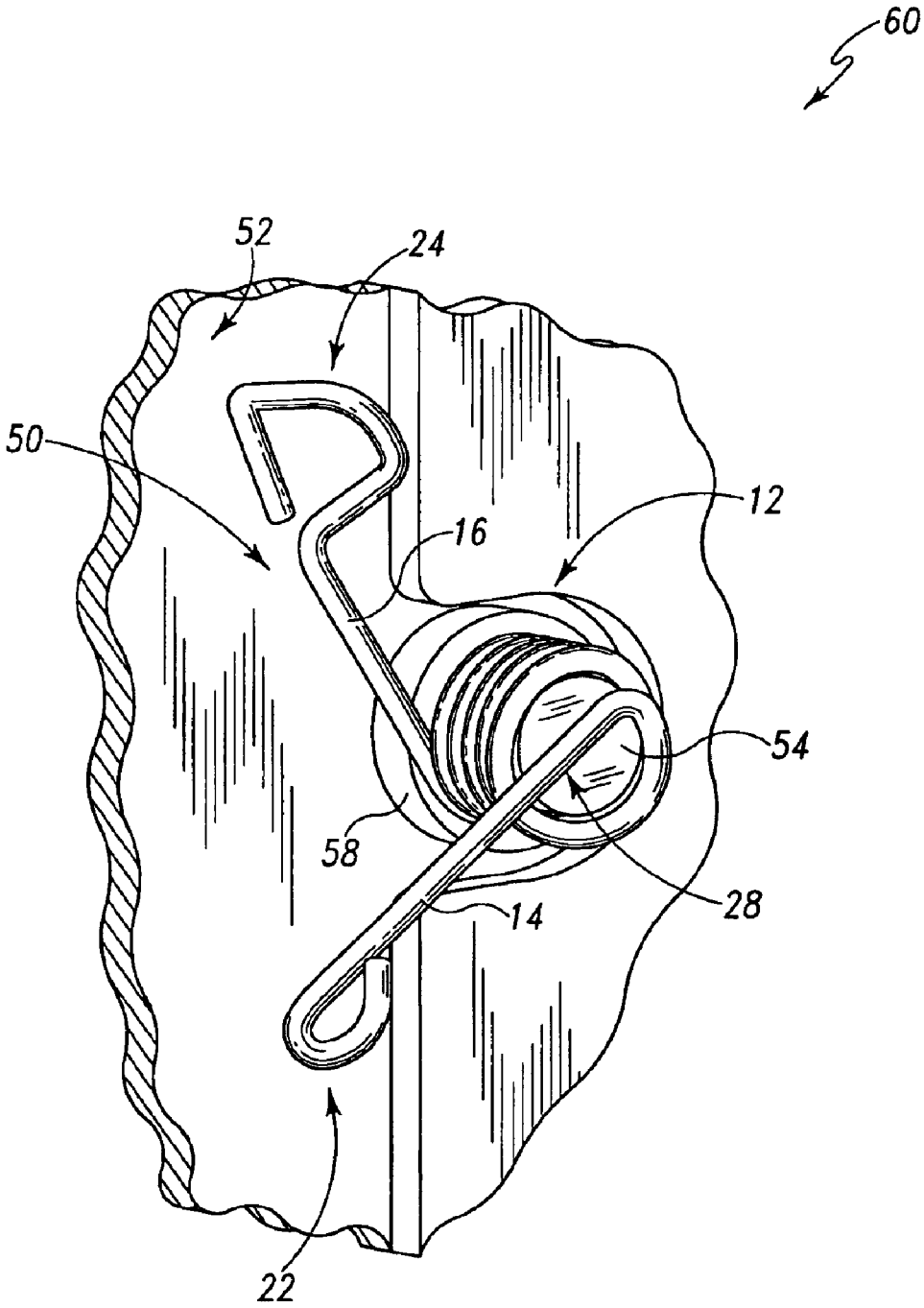
FIG. 4 is a perspective view of the device of FIG. 1 being coupled to the vehicle door switch of FIG. 3 to deactivate the vehicle door switch.

Once the inner diameter of the coil portion 12 of the switch deactivation device 10 has been enlarged, the device 10 may be coupled to the door switch 50 of the vehicle 60 as shown in FIG. 4. The device 10 is coupled to the door switch 50 by sliding the coil portion 12 over the plunger shaft 56 of the door switch 50 while the inner diameter of the coil portion 12 is enlarged. Alternatively, the coil portion 12 may be slid over the mounting flange 58 of the vehicle switch 50 in those embodiments in which the door switch 50 does not include a plunger shaft 56. The coil portion 12 is formed to accommodate a variety plunger shaft 56 and mounting flange 58 diameter sizes. Additionally, coil portions 12 having larger or smaller natural state diameters may be used in those applications in which the vehicle door switch 50 includes alternative or unique shaft 56 or flange 58 diameter sizes.

Once the device 10 is slid over the plunger shaft 56, the user may release the pads 22, 24 causing the inner diameter of the coil portion 12 to decrease toward its relaxed state diameter. The tendency of the inner diameter of the coil portion 12 to resume its relaxed state diameter exerts a force on the shaft 56 (or alternatively, on the flange 58). The force exerted on the shaft 56 by the coil portion 12 secures the device 10 on the switch 50. As the portion 12 is slid over the plunger shaft 56, the plunger-engaging portion 28 of the device 10 contacts or engages the plunger 54 of the vehicle door switch 50. As the coil portion 12 is slid further along the shaft 56, the plunger 54 is retracted or depressed by the plunger-engaging portion 28. The coil portion 12 may be slid downwardly along the shaft 56 until the plunger 54 is fully depressed or until the coil portion 12 contacts the mounting flange 58.

With the device 10 secured to the switch 50 such that the plunger 54 is depressed or retracted by the plunger-engaging portion 28 as shown in FIG. 4, the vehicle door switch 50 is deactivated. As described above, deactivating the door switch 50 causes the associated electrical circuit to operate in a manner as if the associated door of the switch 50 is closed. Certain functions of the associated electrical circuit are deactivated by the interaction of the device 10 and switch 50. For example, with the device 10 coupled to the switch 50, the associated doors of the vehicle 60 may be removed without the overhead light being constantly illuminated because the switch 50 is deactivated by the device 10.

After the device 10 is coupled to the switch 50 as shown in FIG. 4, the device 10 may be rotated about the switch 50. For example, the device 10 may be rotated so that the finger pads 22, 24 do not extend outwardly from the vehicle, but instead are positioned to extend in an inward direction. In such a position, there is a decreased likelihood of the finger pads 22, 24 interfering with user of the vehicle 60 and the surrounding environment such as getting caught on the user's clothes, snagging nearby brush during "off-road" travel, and the like.

The illustrative embodiment of the switch deactivation device 10 disclosed herein is but one example of a switch deactivation device 10. It is contemplated that the device 10 may include other configurations designed according to the particular application in which the device 10 is to be used. For example, the switch deactivation device 10 may have a coil portion 12 having one of a number of internal diameters designed to properly operate with one of a number of vehicle door switch configurations. Additionally, it is contemplated that the device 10 may be used in other switch applications including, but not limited to, alarm switch applications, various trigger switch applications, and other applications including switches having a plunger or plunger-like element. Further, the switch deactivation device 10 may include any number of individual coils 26 determined based on one or more criteria such as switch configuration, size considerations, compression force requirements, environment, and the like. For example, the number of individual coils 26 of the coil portion 12 may be increased to provide additional securing force on the switch 50 when the device 10 is coupled to the switch 50. Yet further, in other embodiments, the device 10 may other types of grippers configured to grip a portion of the switch 50 such as the plunger shaft 54, the mounting flange 58, or other portion of the switch 50. The gripper may be embodied as a coil portion as illustrated and described above in regard to FIG. 1, a friction coupler using friction to grip the portion of switch 50, a clip, an adjustable strap, or other device capable of gripping a portion of the door switch 50.

While the disclosure has been illustrated and described in detail in the drawings and foregoing description, such an illustration and description is to be considered as exemplary and not restrictive in character, it being understood that only illustrative embodiments have been shown and described and that all changes and modifications that come within the spirit of the disclosure are desired to be protected.

There are a plurality of advantages of the present disclosure arising from the various features of the switch deactivation device described herein. It will be noted that alternative embodiments of the switch deactivation device of the present disclosure may not include all of the features described yet still benefit from at least some of the advantages of such features. Those of ordinary skill in the art may readily devise their own implementations of the switch deactivation device that incorporate one or more of the features of the present invention and fall within the spirit and scope of the present disclosure as defined by the appended claims.

What is claimed is:

1. A device for deactivating a vehicle door switch, the device comprising:

a coil portion having at least one coil configured to couple to a portion of the vehicle door switch; and a plunger-engaging portion configured to depress a plunger of the vehicle door switch while the at least one coil is coupled to the portion of the vehicle door switch, the plunger-engaging portion being coupled to the coil portion.

2. The device of claim 1, wherein the coil portion comprises a coil spring.

3. The device of claim 1, wherein the at least one coil has an internal diameter adjustable to allow the at least one coil to be coupled to one of a number of vehicle door switches of varying dimensions.

4. The device of claim 3, wherein the internal diameter is continuously adjustable between (i) a smaller diameter in which the at least one coil applies securing pressure on the portion of the vehicle door switch while the at least one coil is coupled to the portion of the vehicle door switch and (ii) a larger diameter in which the at least one coil is couplable to the portion of the vehicle door switch.

5. The device of claim 1, wherein the at least one coil is configured to couple to a plunger shaft of the vehicle door switch.

6. The device of claim 1, wherein the at least one coil is configured to couple to a mounting flange of the vehicle door switch.

7. The device of claim 1, wherein the coil portion defines a channel configured to receive the portion of the vehicle door switch, the plunger-engaging portion extending over the channel.

8. The device of claim 1, wherein the plunger-engaging portion is configured to maintain the plunger in a depressed position while the at least one coil is coupled to the portion of the vehicle door switch.

9. The device of claim 1, wherein the coil portion and the plunger-engaging portion are made from a material selected from the group consisting of metallic material and plastic material.

10. The device of claim 1, wherein the coil portion is made from spring steel.

11. The device of claim 1, wherein the coil portion is made from music wire.

12. The device of claim 1, wherein the coil portion and the plunger-engaging portion are integral with one another.

13. The device of claim 1, further comprising a first end segment and a second end segment, the coil portion having a first end coupled to the first end segment and a second end coupled to the second end segment.

14. The device of claim 13, wherein the plunger-engaging portion is coupled to the first end segment.

15. The device of claim 13, wherein the plunger-engaging portion forms a portion of the first end segment.

16. The device of claim 13, wherein the first end segment and the second end segment include a finger pad.

17. The device of claim 13, wherein the first end segment and the second end segment are movable toward each other to increase an internal diameter of the at least one coil.

18. A method for deactivating a vehicle door switch with a device having at least one coil, the method comprising:

coupling the at least one coil of the device to a portion of the vehicle door switch; and depressing a plunger of the vehicle door switch with a plunger-engaging portion of the device.

19. The method of claim 18, wherein the coupling step comprises increasing an internal diameter of the at least one coil.

20. A device for deactivating a vehicle door switch, the device comprising:

a coil portion having at least one coil configured to couple to a portion of the vehicle door switch, the coil portion having a first end and a second end;

a first segment coupled to the first end of the coil portion at one end and having a finger pad at an opposite end; and a second segment coupled to the second end of the coil portion at one end and having a finger pad at an opposite end, the second segment including a plunger-engaging portion configured to depress a plunger of the vehicle door switch while the at least one coil is coupled to the portion of the vehicle door switch.

21. A device for deactivating a vehicle door switch comprising a plunger and a plunger receiver for receiving the plunger, the plunger being configured to move relative to the plunger receiver between extended and retracted positions, the device comprising:

a receiver gripper configured to grip the plunger receiver; and a plunger retainer coupled to the receiver gripper and configured to retain the plunger in the retracted position when the receiver gripper grips the plunger receiver.

22. The device of claim 21, further comprising a gripper release, wherein the receiver gripper is configured to move between a grip position gripping the plunger receiver and a release position releasing the plunger receiver, and the gripper release is configured to move the receiver gripper from the grip position to the release position.

* * * * *